US010144556B2

(12) United States Patent
Ohayon

(10) Patent No.: US 10,144,556 B2
(45) Date of Patent: Dec. 4, 2018

(54) INTEGRATED CORK OPENER

(71) Applicant: Shalom Ohayon, Nesher (IL)

(72) Inventor: Shalom Ohayon, Nesher (IL)

( * ) Notice: Subject to any disclaimer, the term of this patent is extended or adjusted under 35 U.S.C. 154(b) by 0 days.

(21) Appl. No.: 15/301,157

(22) PCT Filed: Apr. 28, 2015

(86) PCT No.: PCT/IL2015/050438
§ 371 (c)(1),
(2) Date: Sep. 30, 2016

(87) PCT Pub. No.: WO2015/170313
PCT Pub. Date: Nov. 12, 2015

(65) Prior Publication Data

US 2017/0021977 A1 Jan. 26, 2017

(30) Foreign Application Priority Data

May 5, 2014 (FR) ..... 14 01022
May 7, 2014 (CH) ..... 0684/14

(51) Int. Cl.
*B65D 39/16* (2006.01)
*B67B 7/06* (2006.01)
*B65D 39/00* (2006.01)

(52) U.S. Cl.
CPC ..... *B65D 39/16* (2013.01); *B65D 39/0005* (2013.01); *B67B 7/06* (2013.01)

(58) Field of Classification Search
CPC ..... B65D 39/16; B65D 39/0005; B67B 7/06; B67B 7/066; B67B 7/18; B67B 7/04; B67B 7/0417; B67B 7/0423
USPC ..... 215/355, 364, 228, 299, 296, 295; 220/789, 791, 804, 801, 212.5, 212, 761; 16/429; 81/3.44, 3.4, 3.56, 3.57, 3.55
See application file for complete search history.

(56) References Cited

U.S. PATENT DOCUMENTS 41,532 A * 2/1864 Parker ..... B65D 39/16 215/299
139,905 A * 6/1873 Lyon ..... B65D 1/04 215/299
351,680 A * 10/1886 Wilson ..... B65D 39/16 215/299
523,972 A * 8/1894 Butterfield ..... B65D 39/16 215/299
1,187,984 A * 6/1916 Fortenbaugh ..... B65D 39/16 215/299
1,341,680 A * 6/1920 Spelling ..... B65D 39/16 215/299

(Continued)

FOREIGN PATENT DOCUMENTS

CN 201901312 7/2011
DE 613940 5/1935

(Continued)

*Primary Examiner* — Robert J Hicks
(74) *Attorney, Agent, or Firm* — Malloy & Malloy

(57) ABSTRACT

An integrated cork opener that is integrated into a cork. The cork comprising a body configured in size and in shape to seal a container. The cork further comprises a body pulling apparatus, which includes an anchor and a foldable handle, said body pulling apparatus is integrated into said body. In some exemplary embodiments, a container, such as a wine bottle, may be sealed using a cork comprising an integrated body pulling apparatus.

15 Claims, 4 Drawing Sheets

(56) References Cited

U.S. PATENT DOCUMENTS

| | | | | | |
|---|---|---|---|---|---|
| 1,377,527 | A * | 5/1921 | Spelling | B65D 39/16 | 215/299 |
| 3,073,473 | A * | 1/1963 | Davidson | B65D 39/0047 | 215/364 |
| 4,175,668 | A * | 11/1979 | Hebert | B65D 45/04 | 215/354 |
| 4,889,251 | A | 12/1989 | Hojnoski | | |
| 5,285,917 | A * | 2/1994 | Hoffmann | B65D 50/069 | 215/211 |
| 2014/0054301 | A1* | 2/2014 | Guoqing | B65D 47/0885 | 220/592.17 |

FOREIGN PATENT DOCUMENTS

| | | |
|---|---|---|
| DE | 667977 | 11/1938 |
| WO | 0040502 | 7/2000 |

* cited by examiner

INTEGRATED CORK OPENER

CROSS-REFERENCE TO RELATED APPLICATIONS

This application claims the benefit of Patent Application FR 14 01022, filed May 5, 2014 and of Patent Application CH 2014 0684/14 filed May 7, 2014, both are hereby incorporated by reference in their entirety for every purpose and without giving rise to disavowment.

TECHNICAL FIELD

The present invention relates to corks in general, and specifically to cork openers.

BACKGROUND

Corks stoppers, also referred to as corks, are known in the art and used for sealing containers. Wikipedia, under the entry for BUNG, defines "A bung, stopper or cork is a truncated cylindrical or conical closure to seal a container, such as a bottle, tube or barrel. Unlike a lid, which encloses a container from the outside without displacing the inner volume, a bung is partially inserted inside the container to act as a seal. A glass stopper is often called a "ground glass joint" (or "joint taper"), a rubber stopper is sometimes called a "rubber bung", and a cork stopper is called simply a "cork". Bung stoppers used for wine bottles are referred to as "corks", even when made from another material. A common every-day example of a bung is the cork of a wine bottle. Bungs are used to seal the bunghole of barrels. Other bungs, particularly those used in chemical barrels, may be made of metal and be screwed into place via threading".

There are various types of cork openers that are used for opening corks, and specifically corks of wine bottles. One example of such cork openers is a corkscrew. The corkscrew comprises a steel screw that is screwed into the cork until its helix is firmly embedded in the cork. Once screwed-in, the cork is extracted by pulling the corkscrew. Such cork opener has the disadvantages of being unsafe do to its screw portion and of failing in case of insufficient grip in the cork. In some cases, the cork may break, dropping cork particles into the wine.

SUMMARY

One exemplary embodiment of the disclosed subject matter is a cork comprising: a body configured in size and in shape to seal a container; and an integrated body pulling apparatus that is integrated into said body.

Optionally, said integrated body pulling apparatus is embedded, at least in part, in said body.

Optionally, said integrated body pulling apparatus comprising an anchor embedded internally in said body, wherein said integrated body pulling apparatus further comprises a handle that is connected to said anchor.

Optionally, said handle is connected to said anchor by a pole.

Optionally, said handle is connected to said anchor by an extendible pole having a closed position and an extended position, wherein in the extended position said handle is located about above said body.

Optionally, said body having a top portion and a bottom portion, wherein said integrated body pulling apparatus is embedded, at least in part, in said bottom portion of said body.

Optionally, said integrated body pulling apparatus is anchored internally in a lower third portion of said body.

Optionally, said integrated body pulling apparatus is anchored internally in an inferior portion of said body.

Optionally, said body comprising a housing that is internally located within said body, wherein said housing retaining, at least in part, said integrated body pulling apparatus.

Optionally, said housing being shaped as a cylinder.

Optionally, said integrated body pulling apparatus comprising a handle, wherein said handle is foldable to a folded state, wherein said housing is configured in size and shape to retain said handle in the folded state.

Optionally, said housing comprises one or more gripping members located between said housing and said body.

Optionally, said integrated body pulling apparatus having a strap connected thereto, wherein said integrated body pulling apparatus having a folded state and an extended state, wherein in said folded state said handle is contained within said housing, wherein in said folded state said strap is, at least in part, extended outside said housing.

Optionally, pulling said strap is configured to cause said integrated body pulling apparatus to be extended to the extended state.

Optionally, said integrated body pulling apparatus is vertically extendable along a vertical axis of said body to extend said integrated body pulling apparatus from a folded state to an extended state.

Another exemplary embodiment of the disclosed subject matter is a container comprising a sealable opening, wherein said sealable opening is sealed using a cork in accordance with the disclosed subject matter.

Yet another exemplary embodiment of the disclosed subject matter is a wine bottle comprising a sealable opening, wherein said sealable opening is sealed using a cork in accordance with the disclosed subject matter.

BRIEF DESCRIPTION OF THE DRAWINGS

The present disclosed subject matter will be understood and appreciated more fully from the following detailed description, taken in conjunction with the drawings in which.

DETAILED DESCRIPTION

One technical problem dealt with by the disclosed subject matter is to provide for a cork that can be opened without requiring an external device such as a cork opener. The cork may be used to seal a container, such as a wine bottle, in an air-tight manner and may require force in order to be opened.

Another technical problem is to provide for a crock that is not damaged during its removal so that the cork be re-used to re-seal the container.

One technical solution is to provide a built-in, embedded, body pulling apparatus, that is integrated into the body of the cork. The body pulling apparatus may be configured to allow it to be folded and stored within a housing within the cork. The body pulling apparatus may be embedded within an inferior portion of the cork screw so as that a pulling force applied thereto pulls the corks from the inferior portion thereby providing for an effective cork removal operation.

Figure 1C:
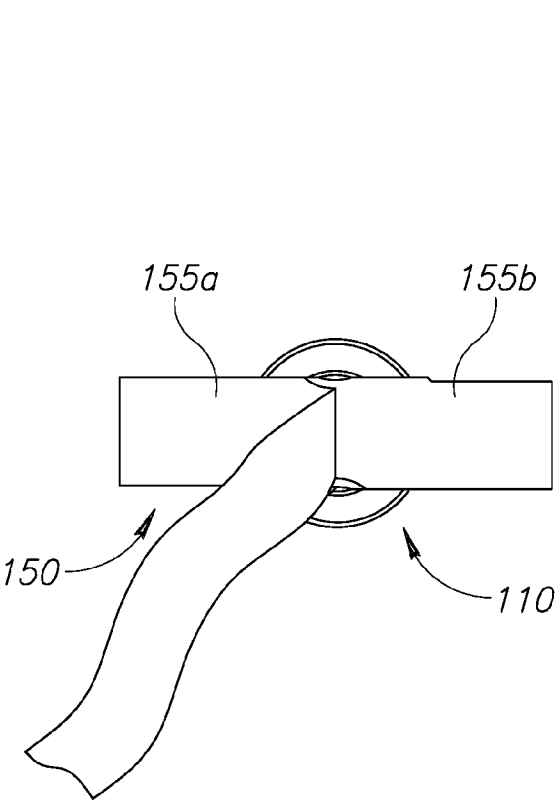
FIG. 1C is a top view of a cork in an extended state, in accordance with some embodiments of the disclosed subject matter.
Figure 1B:
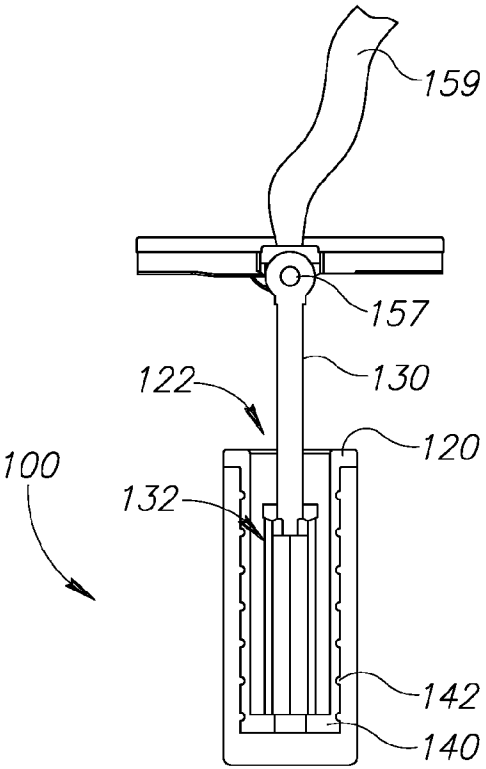
FIG. 1B is a cross section view of a cork in an extended state, in accordance with some embodiments of the disclosed subject matter.
Figure 1A:
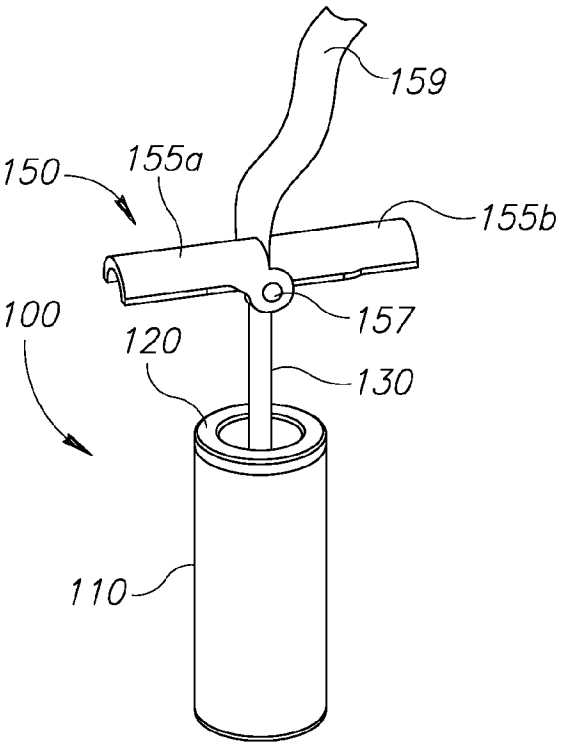
FIG. 1A is an isometric view of a cork in an extended state, in accordance with some embodiments of the disclosed subject matter.

Referring now to FIGS. 1A-1C showing views of a cork, in accordance with some embodiments of the disclosed subject matter.

Cork 100 comprises a Body 110 and an integrated body pulling apparatus that is composed of a Handle 150 and a connecting element connecting Handle 150 to said Body 110. In some exemplary embodiments, Pole 130 may connect Handle 150 to Body 110 either directly or via other components, such as but not limited to Housing 120.

Handle 150 may be composed of two portions (155*a*, 155*b*) that are connected in a Rotation Axis 157. Each portion may be rotatable around Rotation Axis 157 to reach a folded position. In some exemplary embodiments, a spring or similar device may be utilized to provide force to rotate the two portions into an opened state.

Housing 120, having an Interior Storage Volume 122, is embedded internally within Body 110. The body pulling apparatus is connected to Body 110 via Housing 120. As an example, Pole 130 may be connected to Body 110 at a Base 140 of Housing 120. Housing 120 may have a general shape of a hollow cylinder having a smaller radius than a general radius of Body 110.

In some exemplary embodiments, Housing 120 may provide gripping in Body 110, such as to allow for a pulling force applied using Handle 150 to pull Body 110 thereby removing Cork 100 from a sealing opening. In some exemplary embodiments, gripping is provided in an inferior portion of Body 110, located below a middle height point of Body 110. Additionally or alternatively, the gripping is provided in a lower third portion of Body 110. It will be noted that providing gripping only in a superior portion of Body 110 may have, in some cases, an undesirable effect of breaking Cork 100 and not removing Cork 100 entirely.

In some exemplary embodiments, gripping is enhanced using one or more Gripping Members 142, such as protrusions, recesses, abutments, hooks, cantilevers, or the like. In some exemplary embodiments, Gripping Members 142 may be located on side walls of Housing 120. Base 140, Gripping Members 142, or other components of the body pulling apparatus may be used as anchors for providing sufficient grip in Body 110 to allow its removal upon application of sufficient force.

In some exemplary embodiments, Pole 130 may be a telescopic pole that is extendible from a closed position to an extended position. Pole Base 132 may be used as a housing for Pole 130 when in the closed position and for telescopically extending Pole 130 to the extended position.

In some exemplary embodiments, Cork 100 is constructed so that when used for sealing a container, the body pulling apparatus is isolated from a content of the container, such as by Body 110. As a result, the content of the container is not contaminated by body pulling apparatus and such apparatus may be constructed using any material, including but not limited to metal, plastic, or the like.

Figures 1D, 1E, 2A, 2B, 2C:
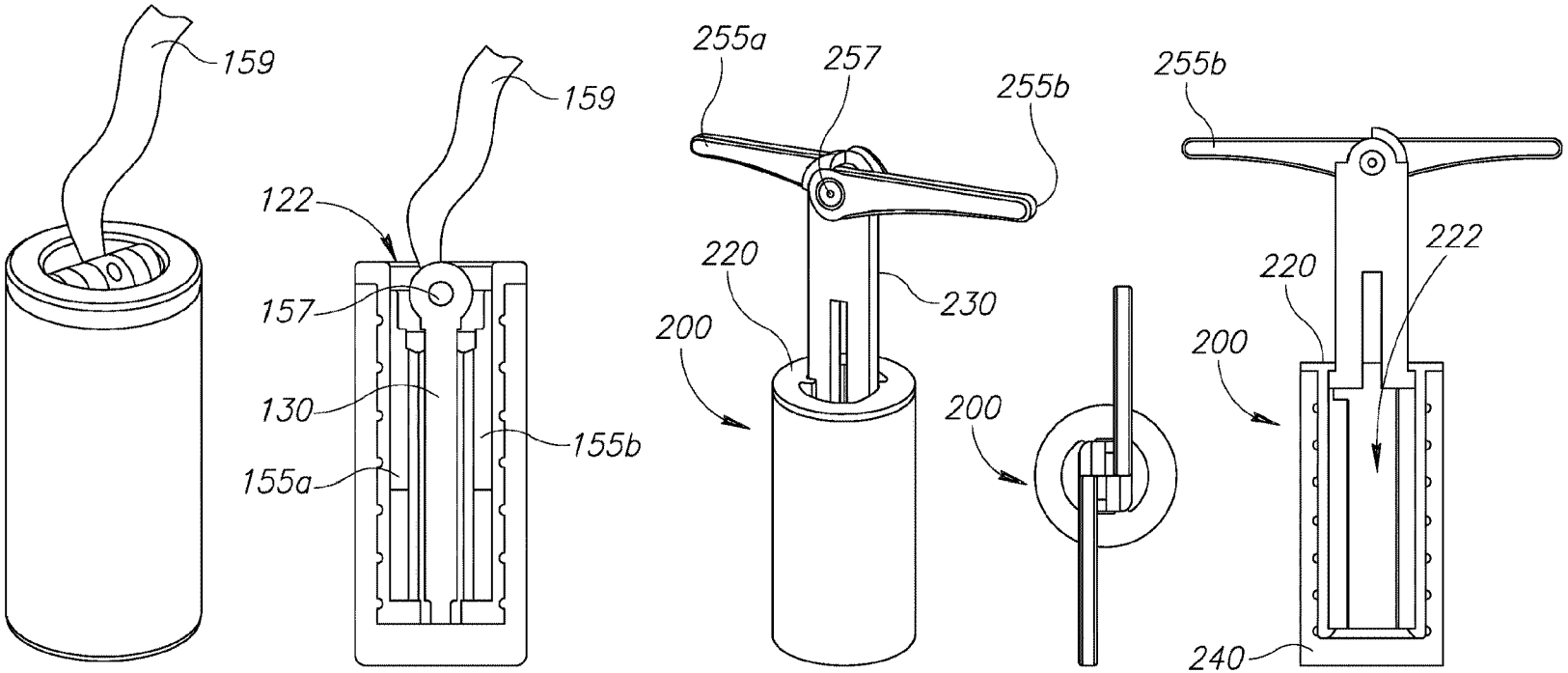
FIG. 1D is an isometric view of a cork in a folded state, in accordance with some embodiments of the disclosed subject matter.
FIG. 1E is a cross section view of a cork in a folded state, in accordance with some embodiments of the disclosed subject matter.
FIGS. 2A-2C are views of a cork, in accordance with some embodiments of the disclosed subject matter.
Figure 3D:
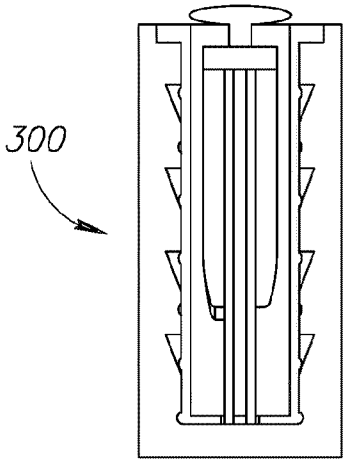
FIGS. 3A-3D are views of a cork, in accordance with some embodiments of the disclosed subject matter.
Figure 3C:
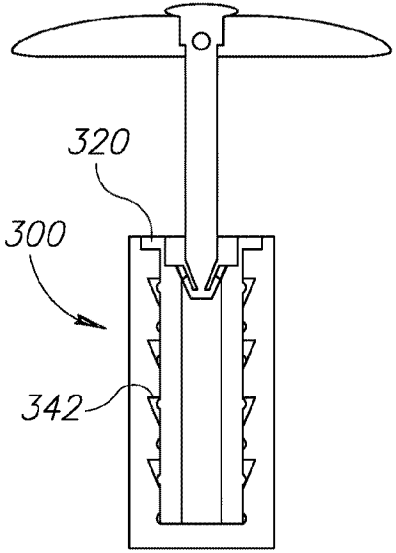
Figure 3B:
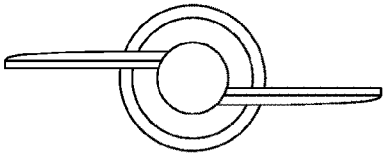
Figure 3A:
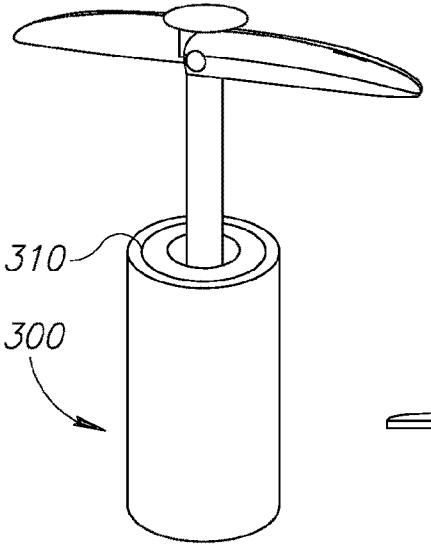

Referring now to FIGS. 1D-1E showing views of Cork 100 in a folded state, in accordance with some embodiments of the disclosed subject matter. It will be appreciated that some corks according to the disclosed subject matter may not be foldable to a folded state and may persistently remain in an extended state, such as the state exemplified in FIGS. 1A-1C.

In a folded state, majority of the body pulling apparatus may be folded and concealed within Interior Storage Volume 122. In some exemplary embodiments, Pole 130 may be retracted into and stored within Pole Base 132. Portion 155*a* and Portion 155*b* may be folded about Axis 157 and retained within Interior Storage Volume 122. In some exemplary embodiments, persistent force, such as provided by a spring (not shown), may be exerted so as to open Portions 155*a* and 155*b* to their open position. In case Body 110 is positioned within a neck of a bottle, such force, when applied in the folded state, may be applied on side walls of Housing 120 and may pressure Body 110 against the neck, thereby potentially increasing a sealing effect of Cork 100. In some exemplary embodiments, such exerted pressure may allow for effective sealing even in case a diameter of Cork 100 is slightly larger than diameter of a corresponding sealing opening (e.g., bottle neck), such as of less than 1 mm, 0.5 mm, or the like.

In some exemplary embodiments, Strap 159 may be connected to top edge of the body pulling apparatus. In some exemplary embodiments, Strap 159 may be connected to Handle 150, Pole 130, or the like. Strap 159 may be extended outside of said Housing 120 so as to allow pulling and thereby changing from the folded state to the extended state. In some exemplary embodiments, Strap 159 may be made from fabric, paper, silicone, rubber, or the like. In some exemplary embodiments, Strap 159 may be accessible in the folded position of Cork 100.

Additionally or alternatively, Cork 100 may include other structures than Strap 159 to allow for extraction of the body pulling apparatus. In some exemplary embodiments, a mini-handle, a pin, or a similar structure may be connected to a top edge of the body pulling apparatus. Additionally or alternatively, a spring-based mechanism may be used to eject the body pulling apparatus upon a release of a spring, such as using a push button.

Referring now to FIGS. 2A-2C showing views of a cork in an open state, in accordance with some embodiments of the disclosed subject matter. Cork 200 may have an open state (as depicted) and a folded state (not shown). Cork 200 may comprise handle composed of Portions (255*a*, 255*b*) which are rotatable around Axis 257. The handle may be connected to the body of Cork 200 via Connecting Member 230 which may be connected at least to Base 240 of Housing 220. In some exemplary embodiments, Housing 220 may comprise Storage 222 sufficient in size and shape to retain the entirety of Connecting Member 230 and Portions 255*a* and 255*b*, when in folded state.

Referring now to FIGS. 3A-3D showing views of a cork, in accordance with some embodiments of the disclosed subject matter. Along the walls of Housing 320, Gripping Members 342 may provide for the body pulling apparatus sufficient grip into the body 310.

Figure 4:
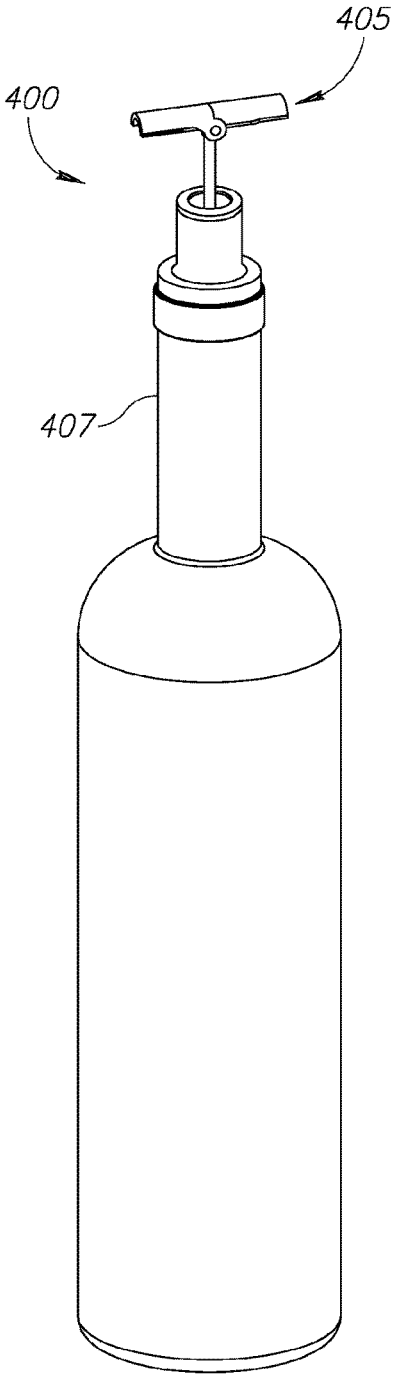
FIG. 4 shows an illustration of a bottle, in accordance with some embodiments of the disclosed subject matter.

Referring now to FIG. 4 showing an illustration of a bottle, in accordance with some embodiments of the disclosed subject matter. Cork 400 may have embedded therein a Body Pulling Apparatus 405 useful for extracting Cork 400 from Bottle 407.

Figure 5:
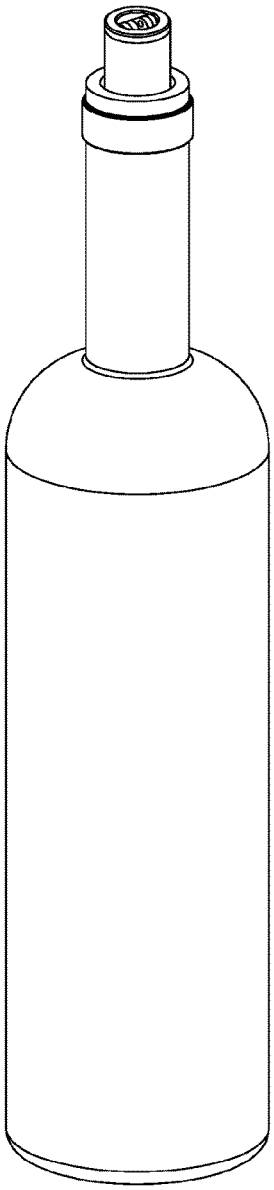
FIG. 5 shows an illustration of a bottle, in accordance with some embodiments of the disclosed subject matter.

In some exemplary embodiments, Cork 400 may be initially provided in a closed state, such as shown in FIG. 5, and prior to removal of Cork 400, Body Pulling Apparatus 405 may be extracted.

Figure 6:
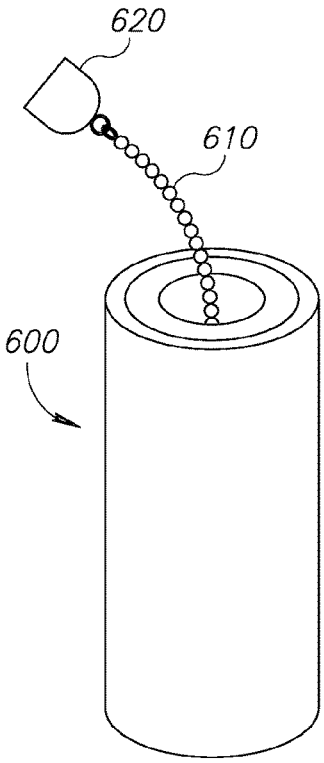
FIG. 6 is a view of a cork, in accordance with some embodiments of the disclosed subject matter.

FIG. 6 is a view of a cork, in accordance with some embodiments of the disclosed subject matter. Body pulling apparatus 620 of Cork 600 may comprise a Connecting Member 610. Connecting Member 610 may be a chain, a rope, or the like.

It will be noted that the term "cork", as used herein, refers to a sealing element that may be made from any material, including but not limited to cork, silicon, or the like.

It will be noted that although the present disclosure focuses on an embodiment of using a cork for wine bottles, the disclosed subject matter is not limited to such an embodiment and may be used for sealing other containers as well.

It will be appreciated by persons skilled in the art that the present invention is not limited by what has been particularly shown and described hereinabove. Rather the scope of the invention also includes variations and modifications that would occur to persons skilled in the art upon reading the foregoing description and which are not in the prior art.

The flowchart and block diagrams in the Figures illustrate the architecture, functionality, and operation of possible implementations of systems, methods and computer program products according to various embodiments of the present disclosed subject matter. It should also be noted that, in some alternative implementations, the functions noted in the block may occur out of the order noted in the figures. For example, two blocks shown in succession may, in fact, be executed substantially concurrently, or the blocks may sometimes be performed in the reverse order, depending upon the functionality involved.

The terminology used herein is for the purpose of describing particular embodiments only and is not intended to be limiting of the disclosed subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosed subject matter has been presented for purposes of illustration and description, but is not intended to be exhaustive or limited to the disclosed subject matter in the form disclosed. Many modifications and variations will be apparent to those of ordinary skill in the art without departing from the scope and spirit of the disclosed subject matter. The embodiment was chosen and described in order to best explain the principles of the disclosed subject matter and the practical application, and to enable others of ordinary skill in the art to understand the disclosed subject matter for various embodiments with various modifications as are suited to the particular use contemplated.

The invention claimed is:

1. A cork comprising:

a body configured in size and in shape to seal a container;

an integrated body pulling apparatus that is integrated into said body, said integrated body pulling apparatus comprising a handle;

said body comprising a housing that is internally located within said body, said housing retaining, at least in part, said integrated body pulling apparatus; and said integrated body pulling apparatus having a strap connected thereto, said integrated body pulling apparatus having a folded state and an extended state, wherein in said folded state said handle is contained within said housing and said strap is, at least in part, extended outside said housing.

2. The cork of claim 1, wherein said integrated body pulling apparatus is embedded, at least in part, in said body.

3. The cork of claim 1, wherein said integrated body pulling apparatus comprising an anchor embedded internally in said body, wherein said integrated body pulling apparatus further comprises a handle that is connected to said anchor.

4. The cork of claim 3, wherein said handle is connected to said anchor by a pole.

5. The cork of claim 3, wherein said handle is connected to said anchor by an extendible pole having a closed position and an extended position, wherein in the extended position said handle is located above said body.

6. The cork of claim 1, wherein said body having a top portion and a bottom portion, wherein said integrated body pulling apparatus is embedded, at least in part, in said bottom portion of said body.

7. The cork of claim 1, wherein said integrated body pulling apparatus is anchored internally in a lower third portion of said body.

8. The cork of claim 1, wherein said integrated body pulling apparatus is anchored internally in an inferior portion of said body.

9. The cork of claim 1, wherein said housing being shaped as a cylinder.

10. The cork of claim 1, wherein said handle is foldable to a folded state, and said housing is configured in size and shape to retain said handle in said folded state.

11. The cork of claim 1, wherein said housing comprises one or more gripping members located between said housing and said body.

12. The cork of claim 1, wherein pulling said strap is configured to cause said integrated body pulling apparatus to be extended to the extended state.

13. The cork of claim 1, wherein said integrated body pulling apparatus is vertically extendable along a vertical axis of said body to extend said integrated body pulling apparatus from a folded state to an extended state.

14. A container comprising a sealable opening, wherein said sealable opening is sealed using the cork of claim 1.

15. A wine bottle comprising a sealable opening, wherein said sealable opening is sealed using the cork of claim 1.

* * * * *